US005549128A

United States Patent [19]

Mansur

[11] Patent Number: 5,549,128

[45] **Date of Patent: * Aug. 27, 1996**

[54] GENERAL PARTS WASHER

[75] Inventor: Pierre G. Mansur, Miami, Fla.

[73] Assignee: Mansur Industries Inc., Miami, Fla.

[ * ] Notice: The portion of the term of this patent subsequent to Sep. 27, 2011, has been disclaimed.

[21] Appl. No.: 394,290

[22] Filed: Feb. 24, 1995

[51] Int. Cl.[6] ..... B08B 3/10

[52] U.S. Cl. ..... 134/104.1; 134/104.4; 134/108; 134/111

[58] Field of Search ..... 134/104.1, 104.4, 134/105, 107, 108, 109, 111; 202/170

[56] References Cited

U.S. PATENT DOCUMENTS

| | | | |
|---|---|---|---|
| 1,697,767 | 1/1929 | Hirst . | |
| 2,070,204 | 2/1937 | Hetzer . | |
| 2,243,093 | 5/1941 | Flahive . | |
| 2,352,356 | 6/1944 | Albertson . | |
| 2,682,273 | 6/1954 | Roach . | |
| 2,698,288 | 12/1954 | Dinley, Jr. . | |
| 2,834,359 | 5/1958 | Kearney | 134/108 X |
| 2,924,557 | 2/1960 | De Furia . | |
| 3,011,924 | 12/1961 | Rand . | |
| 3,070,463 | 12/1962 | Barday . | |
| 3,177,126 | 4/1965 | Charreau . | |
| 3,598,131 | 8/1971 | Weihe, Jr. | 134/107 |
| 3,610,260 | 10/1971 | Kearney . | |
| 3,707,404 | 12/1972 | Carlson et al. . | |
| 3,718,147 | 2/1973 | Laroche | 134/108 X |
| 3,771,539 | 11/1973 | De Santis . | |
| 3,915,808 | 10/1975 | Wilcox . | |
| 3,996,949 | 12/1976 | Boynton | 134/108 X |
| 4,008,729 | 2/1977 | Chizinsky | 134/107 |
| 4,051,858 | 10/1977 | Mele . | |
| 4,101,340 | 7/1978 | Rand . | |
| 4,122,861 | 10/1978 | Lee . | |
| 4,141,373 | 2/1979 | Kartanson et al. . | |
| 4,170,240 | 10/1979 | Gentry . | |
| 4,223,140 | 9/1980 | Hirdler et al. | 544/192 |
| 4,290,439 | 9/1981 | Charpentier | 134/107 |
| 4,299,663 | 11/1981 | McCord . | |
| 4,353,323 | 10/1982 | Koblenzer | 134/107 X |
| 4,433,698 | 2/1984 | Blaul . | |
| 4,443,269 | 4/1984 | Capella et al. . | |
| 4,451,298 | 5/1984 | Yagishita et al. . | |
| 4,505,284 | 3/1985 | Kyatt . | |
| 4,581,133 | 4/1986 | Tomes . | |
| 4,596,634 | 6/1986 | McCord | 134/107 X |
| 4,616,377 | 10/1986 | Urbani . | |
| 4,707,878 | 11/1987 | Urbani . | |
| 4,715,868 | 12/1987 | Kennedy | 95/94 |
| 4,755,261 | 7/1988 | McCord et al. . | |
| 4,770,197 | 9/1988 | Prisco, Jr. et al. . | |
| 4,771,503 | 9/1988 | Urbani . | |

(List continued on next page.)

FOREIGN PATENT DOCUMENTS

| | | | |
|---|---|---|---|
| 662742 | 3/1929 | France | 134/105 |
| 2394334 | 2/1979 | France | 134/109 |
| 369641 | 12/1958 | Switzerland . | |
| 290285 | 12/1928 | United Kingdom . | |

*Primary Examiner*—Philip R. Coe
*Attorney, Agent, or Firm*—Robert M. Downey, P.A.

[57] ABSTRACT

An apparatus for washing automotive, aviation, marine and other general parts with a cleaning solution during maintenance, repair and rebuilding operations, includes a solution holding reservoir, a wash basin with a drain to facilitate return of the cleaning solution to the holding reservoir, and a pump in the holding reservoir for recirculating the cleaning solution through a discharge spout and into the wash basin for washing parts therein. A first valve assembly between the drain and the cleaning solution holding reservoir closes during periods of non-use to prevent vapors from escaping to the atmosphere. During a recycling process, a second valve assembly releases used, contaminated solvent from the holding reservoir into a distillation chamber where the solvent is heated to produce vapors. A condenser cools the vapors to a liquid state, yielding non-contaminated cleaning solution, which is directed into the holding reservoir for future parts washing as demanded.

12 Claims, 3 Drawing Sheets

U.S. PATENT DOCUMENTS 4,785,836 11/1988 Yamamoto .
4,865,061 9/1989 Fowler et al. ..... 134/108
4,874,472 10/1989 Kohler .
4,879,004 11/1989 Oesch et al. .
4,929,312 5/1990 Westcott .
5,069,755 12/1991 Durr et al. .
5,095,925 3/1992 Elledge et al. .
5,141,009 8/1992 Morantz ..... 134/104.1 X
5,180,438 1/1993 Hockh et al. .
5,193,561 3/1993 Robb et al. .
5,232,299 8/1993 Hiss .
5,318,056 6/1994 Kusz et al. .
5,349,974 9/1994 Mansur ..... 134/108 X
5,357,771 10/1994 Schaal .
5,377,705 1/1995 Smith, Jr. et al. .
5,402,806 4/1995 Hakeem et al. .
5,415,193 5/1995 Taricco .

GENERAL PARTS WASHER

BACKGROUND OF THE INVENTION

1. Field of the Invention

This invention relates to an apparatus for washing articles with a liquid cleaning solution, and more particularly to a general parts washer providing for recycling of contaminated, dirty cleaning solution during a recycling process to produce fresh, non-contaminated cleaning solution on a regular basis for use in washing parts during maintenance, repair and rebuilding operations.

2. Description of the Related Art

During maintenance, repair and rebuilding operations in virtually all industrial and commercial environments, it is necessary to wash a wide variety of parts and articles in order to remove grease, oil, dirt and other contaminants. Typically, volatile solvents or aqueous solutions are used in small parts cleaning operations, as they have been found to be most effective in removing grease and other accumulated residue from metal parts and other articles.

In order to facilitate washing of various parts with a cleaning solvent, such as a hydrocarbon or halogenated hydrocarbon, there is presently available a sink which is removably supported on the top of a 55 gallon drum filled with cleaning solvent. A pump is provided which pumps the solvent from the drum to a spicket in the sink where it is used to rinse parts. From the sink, the solvent is drained back into the drum. During washing operations, the solvent becomes immediately contaminated after the first use. However, the contaminated solvent is continuously used during cleaning operations until a next scheduled solvent replacement, which is usually on a monthly basis. The regular replacement of contaminated solvent is ordinarily provided by a service, which also supplies the washing apparatus, on a service contract basis. To replace the solvent, the sink is removed from the drum containing the contaminated solvent and is placed on another drum containing fresh solvent. The contaminated drum of solvent must then be taken away and disposed of in a manner complying with EPA contaminant disposal guidelines. This procedure is inefficient, costly and time consuming, leaving a busy manufacturing or repair facility with no other alternative than to perform parts cleaning operations using dirty, contaminated solvent between scheduled solvent replacement dates.

The present invention improves upon my previous parts washing apparatus as set forth in U.S. Pat. No. 5,349,974, the subject matter of which is incorporated herein by reference. Specifically, the present invention provides for the optional elimination of a vacuum pump during the distillation process if the atmospheric vaporization temperature of the cleaning solution being used is not dangerously high, and thus safe distillation at atmospheric pressure can be achieved. Also, the present invention eliminates the need for a removable lid on the distillation chamber due to the sloping bottom configuration of the distillation chamber which is specifically structured to centrally gather contaminants which remain in the distillation chamber. To gain access to the distillation chamber and remove the contaminants, a small port with a threaded cap and seal may be provided on the lower front of the distillation chamber, the cap being exteriorly accessible on the front of the apparatus. This structural modification provides for easier cleaning of the distillation chamber, in less time, and substantially reduces the cost of production of the apparatus. Further, in instances where it is desirous to distill under a vacuum, or partial vacuum, the present invention provides for the use of a liquid ring vacuum pump. A primary advantage of liquid ring vacuum pumps is that they have a substantially longer operating life than other vacuum pumps due to their nature of operation, using liquid, as the means for creating a seal, eliminating friction and wear. Further, the liquid ring vacuum pump used in the present invention operates on standard 110 volt power, providing for greater efficiency. To accommodate a liquid ring vacuum pump, and prevent damage thereto, the present invention employs the use of a secondary reservoir, enabling the vacuum pump to operate using non-contaminated cleaning solution.

SUMMARY OF THE INVENTION

The present invention is directed to an apparatus for rinsing and washing (cleaning) articles such as general machine and engine parts, which provides pure, fresh cleaning solution on demand.

More particularly, the present invention provides for the recycling of contaminated, dirty cleaning solution (including solvents and aqueous cleaning solutions) on a regular basis to provide fresh, non-contaminated solution for cleaning, and thus eliminating the need for regular replacement and disposal of contaminated cleaning solution. Accordingly, the present invention provides a practical and economical means for complying with contaminant disposal guidelines of the Environmental Protection Agency (EPA).

In accordance with the general parts washing apparatus of the present invention, there is provided a wash basin including an at least partially surrounding wall structure defining a splash guard, an open top and a removable front wall portion. The wash basin further includes a floor which slopes slightly downward from the sides, front and rear towards a centrally disposed drain to facilitate recovery of cleaning solution after use. Once the cleaning solution has passed through the drain and a filter, the cleaning solution returns to a holding reservoir. A pump recirculates the cleaning solution from the holding reservoir to a spout which discharges the cleaning solution into the wash basin for rinsing articles during what might be termed a wash cycle.

During a recycling process, a containment valve assembly is opened, releasing the cleaning solution from within the holding reservoir to a distillation chamber. Once the cleaning solution has drained into the distillation chamber, the containment valve assembly is closed and the cleaning solution is heated to a boiling point resulting in vapors entering a condenser. In the condenser, the vapors condense to a liquid state, producing fresh, recycled cleaning solution. This fresh cleaning solution is then lead into a holding reservoir for subsequent use during the wash cycle.

A vacuum pump may be used to create a vacuum in the distillation chamber, thereby lowering the cleaning solution boiling point temperature. In a preferred embodiment, a liquid ring vacuum pump is used to provide extended pump life and greater efficiency to the apparatus. In this instance, the condensed, purified cleaning solution is directed from the distillation chamber to a secondary holding reservoir, enabling contaminated cleaning solution in the primary holding reservoir to be dumped into the distillation chamber. In this manner, the fresh cleaning solution, once transferred from the secondary holding reservoir to the primary holding reservoir, can be used to operate the liquid ring vacuum pump which requires solution free of sediment and contaminants in order to prevent damage thereto.

Accordingly, with the foregoing in mind, it is a primary object of the present invention to provide a general parts washing apparatus for use in cleaning parts during maintenance, repair and rebuilding operations, and which includes means for recovering and recycling cleaning solutions so as to provide a user with "on-demand" pure cleaning solution on a regular basis for cleaning.

It is another object of the present invention to provide a general parts washing apparatus, as described above, which eliminates the need for constant replacement and disposal of contaminated cleaning solution while providing a practical and economical means of complying with EPA contaminant disposal guidelines.

It is a further object of the present invention to provide a relatively compact and inexpensive parts washing apparatus adapted to recycle cleaning solutions so as to provide fresh, non-contaminated cleaning solution on a regular basis.

It is still a further object of the present invention to provide a general parts washing apparatus as described above which operates on standard 110 volts and which further requires no special water or air requirements.

It is still another object of the present invention to provide an improved general parts washing apparatus which may incorporate the use of a liquid ring vacuum pump operating on 110 volts, and thus providing an extended pump life and greater efficiency.

It is yet another object of the present invention to provide a general parts washing apparatus as described above, including a distillation chamber having a bottom structured and disposed to gather contaminants contained therein, thereby enabling the contaminants to be removed through a small port and eliminating the need for a removable lid and a lid lifting assembly, resulting in greater efficiency and reduced cost of construction.

It is still another object of the present invention to provide a general parts washing apparatus as described above which complies with all government imposed safety regulations and requirements.

These and other objects and advantages of the present invention will be more readily apparent in the description which follows.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 2:
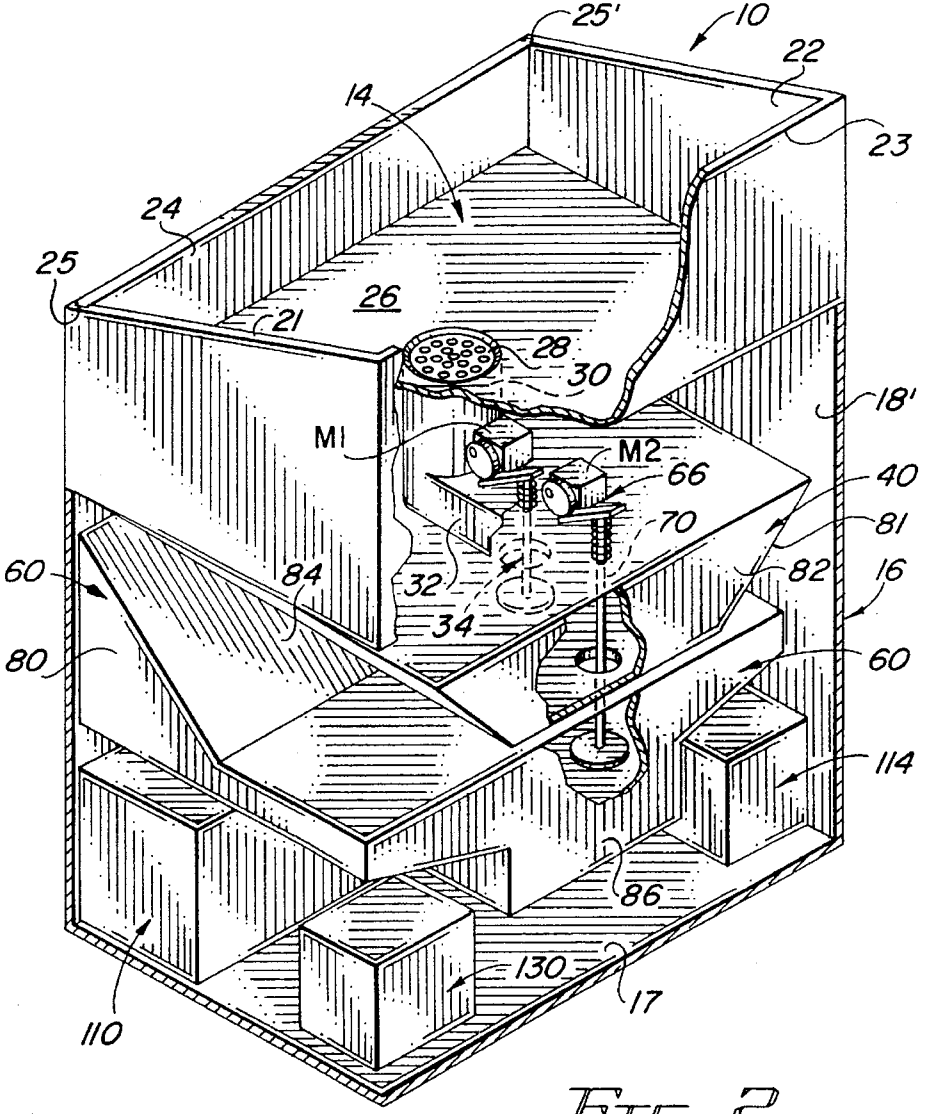
FIG. 2 is a rear top perspective view, in partial cutaway illustrating the primary structural components, in general form, contained within a cabinet interior of the apparatus.
Figure 1:
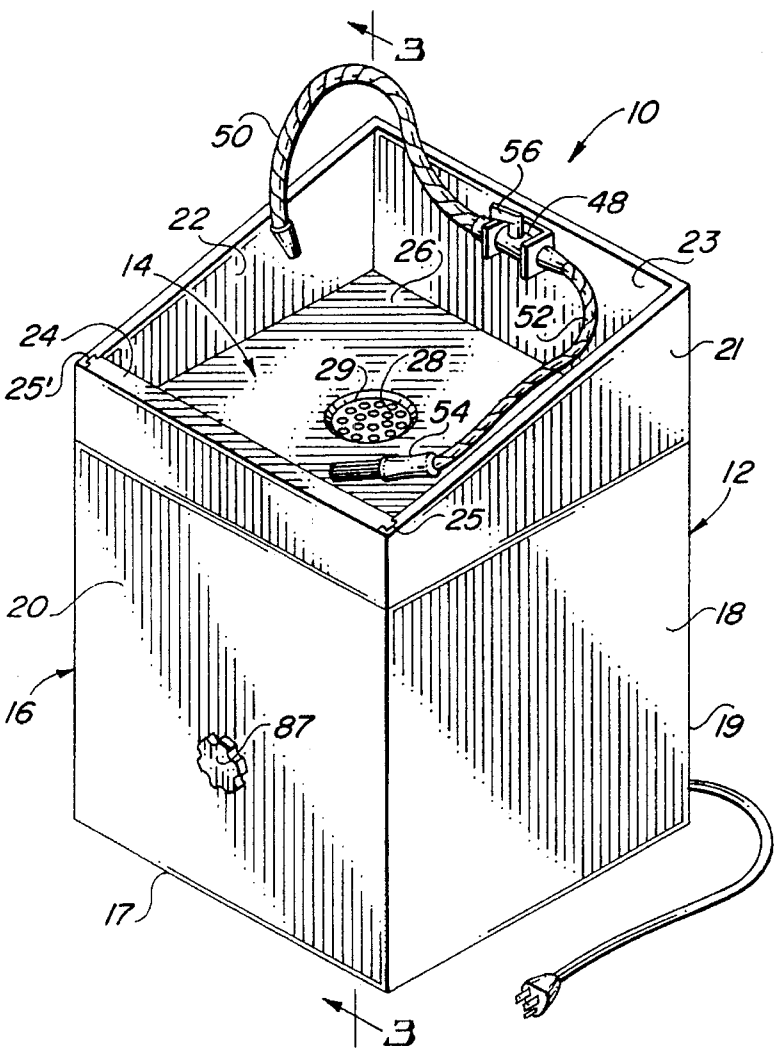
FIG. 1 is a front, top perspective view of the general parts washer apparatus of the present invention.

Referring to the several views of the drawings, and initially FIG. 1, there is generally illustrated the general parts washer apparatus 10 of the present invention. The apparatus 10 may be provided with a cabinet 12 including an upper portion defining a wash basin 14 and a lower portion 16 including a base 17, side walls 18, 18' rear wall 19 and a front wall 20. The wash basin 14 includes side wall portions 21, 22 and a rear wall portion 23 partially surrounding the wash basin 14, and defining a splash guard. A front wall panel 24 is removably fitted within opposite channels 25, 25' formed in the opposite side wall portions 21, 22 of the wash basin 14. During washing operations, the front wall panel 24 can be pulled upwardly and removed from a remainder of the apparatus 10. In this manner, access to the wash basin 14 is unobstructed from a front of the apparatus 10.

The floor 26 in the wash basin 14 is preferably sloped from the sides, rear and front, downwardly from a central zone where there is located a drain 28 including a drain plate 29 through which cleaning solution drains after use for washing articles in the wash basin 14. After passage through the drain plate 29, the cleaning solution is directed through a filter 30 fitted directly below the drain plate. From the filter, the cleaning solution is lead through a return canal 32 which leads to a cleaning solution holding tank 40. A vapor containment valve assembly 34 is provided at the connection of the return canal 32 to the holding tank 40. During periods of non-use, the vapor containment valve is closed, thus preventing vapors from escaping to atmosphere from within the holding tank 40. The holding tank 40 is sized and configured to contain a predetermined amount of cleaning solution therein. The cleaning solution is recycled and reused throughout operation of the apparatus.

A pump 44, supported within the holding tank 40, recirculates the cleaning solution in the holding tank 40 through a return conduit 46 leading to a 3-way valve 48 interconnecting between the return conduit and a spout 50 and a hose 52 having a wash brush 54 attached to an end thereof. A valve lever 56 facilitates operation of the valve to direct flow of cleaning solution to either or both the spout 50 and hose 52 for subsequent discharge into the wash basin 14 (see FIGS. 1, 3 and 4). The brush 54 attached to the hose 52 is specifically designed to permit fluid flow therethrough so that articles may be brushed and simultaneously rinsed with cleaning solution to remove accumulated grease, dirt and other contaminants from the articles being washed. Once discharged from either the spout 50 or brush 54, the cleaning solution returns to the holding tank 40 through the drain 28 and return canal 32. An electric switch is provided and is easily accessible on an exterior of the apparatus 10 (not shown for purposes of clarity) to facilitate deactivation of the pump 44 during periods of non-use. To this point, a wash cycle has been defined which continues during parts washing operations.

Figure 3:
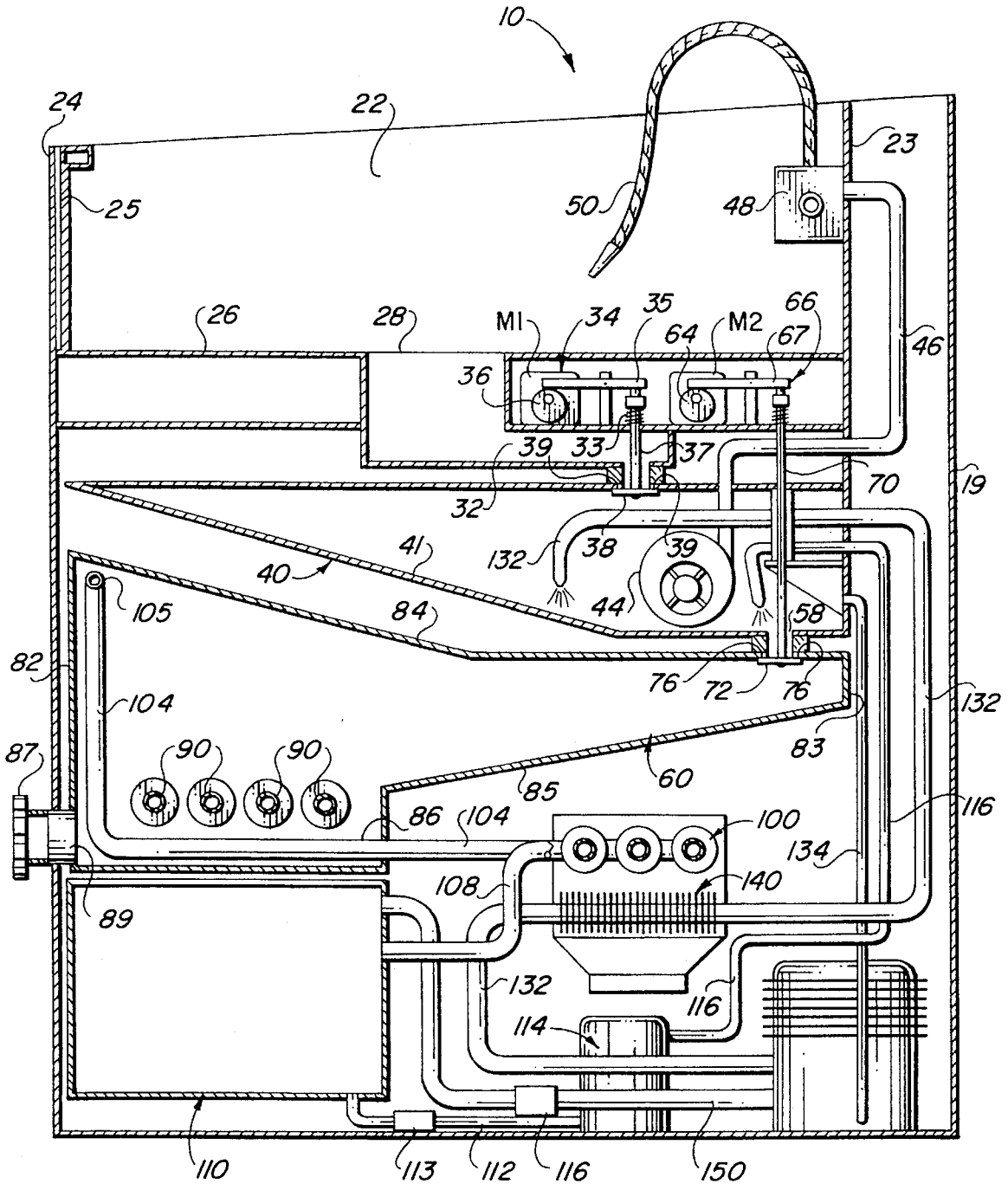
FIG. 3 is a side elevation, in partial section, illustrating the structure and interconnection of the components of the apparatus.
Figure 4:
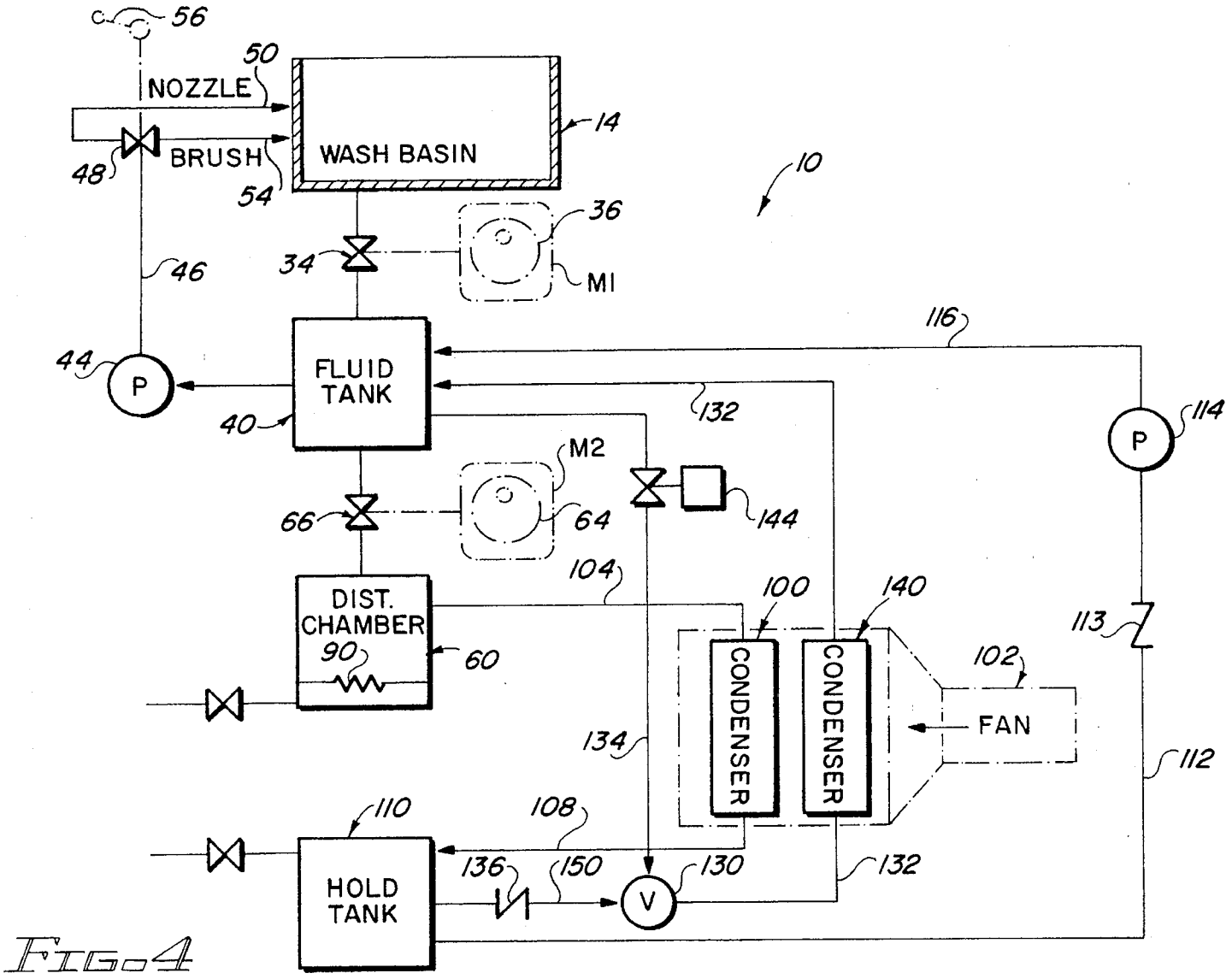
FIG. 4 is a schematic diagram illustrating the functional relationship between the various components of the present invention.

After a period of washing operations, at such intervals as may be selectively determined, the cleaning solution contained within the holding tank 40 (now contaminated after being used for washing various articles in the wash basin) is released into a distillation chamber 60. Referring to FIGS. 3 and 4, at the initiation of a recycling process, the vapor containment valve assembly 34 is closed by motor M1, or solenoid, which rotates a cam 36 moving lever 35, resulting in spring 33 urging valve stem 37 upward and causing the valve head 38 to mate against valve seat 39, and thus preventing vapors within the holding tank 40 from escaping to atmosphere. The vapor containment valve assembly 34 is operated in a similar manner during all periods of non-use, as a safety measure to prevent vapors from escaping. In the recycling process, motor M2 (or solenoid) is activated causing rotation of cam member 64, thereby operating a cleaning solution containment valve assembly 66. Upon initiation of the recycling process, partial rotation of cam member 64 moves lever 67 which applies an axial downward force on valve stem 70 to release a valve head 72 from engagement with a valve seat 76. Upon opening of the cleaning solution containment valve assembly 66, the contaminated cleaning solution is released from within the holding tank 40 through transfer canal 58 and into the distillation chamber 60. The bottom 41 of the holding tank 40 is specifically configured to slope toward the cleaning solution containment valve assembly 66, as seen in FIG. 3, so that upon opening of the valve assembly 66, the cleaning solution will readily flow through the transfer canal 58 and into the distillation chamber 60. Thereafter, a small amount of purified cleaning solution is sprayed onto the valve seat 76 as well as the bottom 41 of the holding tank 40 (as described more fully hereinafter) in order to wash sediment into the distillation chamber, leaving the now empty holding tank 40 clean and generally free of contaminants. The distillation chamber includes side walls 80, 81, a front wall 82, rear wall 83, a bottom 85 and a ceiling 84. The distillation chamber 60 is insulated on all sides, the bottom and top thereof to maintain heat therein. The bottom 85 of the distillation chamber 60 is specifically structured and configured to slope downwardly towards a lower central zone 86 so that sediment and other contaminants will settle and gather at the central zone 86, facilitating easier cleaning thereof. A removable cap 87 on the front of the apparatus removably fits in covering, sealing relation to a port 89 formed through the front wall of the distillation chamber 60 near the lower central zone 86. Removal of the cap 87 facilitates access to an interior of the distillation chamber 60, enabling accumulated contaminants in the lower central zone to be periodically removed. A tool, such as a spade on a rod, can be used to reach through the port 89 and scrape the bottom of the distillation chamber 60, pulling accumulated sediment out through the port. Once cleaned, the cap is replaced in covering, sealed relation on the port so that liquid and vapors do no escape therefrom during the distillation process.

A plurality of heating elements 90 are provided within the distillation chamber 60 to heat the cleaning solution to a temperature sufficient to produce vapors for distillation. The heating elements 90 may be comprised of electrically operated elongate elements each individually fitted within a tube which extends within an interior of the distillation chamber 60, so that the tubes are surrounded by the cleaning solution.

A condenser 100 is positioned and disposed within a cooling zone and is cooled by a fan 102. The condenser 100 includes a first conduit 104 extending to and terminating at an open distal end within an upper portion of the distillation chamber 60. The open end 105 of the conduit 104 is specifically positioned and disposed for receipt of vapors therethrough. The vapors are thereafter led through the conduit 104 to the condenser 100, wherein the vapors are condensed to yield fresh, non-contaminated cleaning solution. A second conduit 108 extends from the condenser 100 to a second lower cleaning solution holding tank 110. The distilled, purified cleaning solution is directed into the lower holding tank 110 for temporary storage. At this point there is a separate charge of cleaning solution contained in the upper holding tank 40. When the charge of cleaning solution in the upper holding tank 40 is contaminated from parts washing operations, and recycling is needed, the charge of cleaning solution is released from the holding tank 40 into the distillation chamber 60, as described above. Thereafter, a small quantity (approximately one to two pints) of the purified, fresh cleaning solution in the second, lower holding tank 110 is dispersed into the upper tank 40 from a transfer line 116 leading from transfer pump 114. The transfer pump 114 is interconnected to the bottom of the lower holding tank 110 by line 112 having a check valve 113 therebetween, to hold vacuum, as described hereinafter. The small quantity of cleaning solution dispersed on the valve assembly 66, removes sediment from the valve seat 76. At the same time, a liquid ring vacuum pump 130 discharges a small quantity of fresh cleaning solution contained therein, and within an output line 132, onto the sloped bottom 41 of the holding tank 40 to wash the sediment through the transfer canal 58 and into the distillation chamber 60. Once the holding tank 40 and valve assembly 66 are rinsed, the containment valve assembly 66 closes to seal off the distillation chamber 60. At this point, the transfer pump 114 is activated, resulting in the purified, non-contaminated cleaning solution in the lower holding tank 110 being transferred into the upper holding tank 40. When the charge of purified cleaning solution has been completely transferred from the lower tank 110 to the upper tank 40, liquid ring vacuum pump 130 is activated. The purified cleaning solution is drawn through an intake line 134 from the holding tank 40 to the vacuum pump 130, where it is thereafter discharged through output line 132, and through a second condenser 140 for cooling prior to returning to the holding tank 40. Operation of the vacuum pump 130 results in a suction through vacuum line 150 leading to an upper portion of the lower holding tank 110. Continued operation of the vacuum pump 130 results in a vacuum being formed in the lower holding tank 110, the condenser 100 and the distillation chamber 60. In this manner, the temperature at which the cleaning solution will vaporize is substantially lowered, resulting in greater efficiency in the operation of the apparatus 10. To hold the vacuum in the distillation chamber 60, and the lower holding tank 110, a second check valve 136 is provided along the vacuum line. Referring to FIG. 4, a solenoid valve 144 is provided in the fluid intake line 134 leading from the holding tank 40 to the vacuum pump 130. Once a vacuum is achieved in the distillation chamber 60, the solenoid valve 144 is closed and the vacuum pump 130 is deactivated. Thus, the solenoid valve 144 prevents the cleaning solution from draining from the holding tank 40 and backing up into the vacuum pump 130. The contaminated cleaning solution in the distillation chamber 60 is thereafter heated and vaporized, as described above, resulting in the distilled, purified cleaning solution being collected in the lower holding tank 110. Subsequent recycling is repeated in the same manner as described above.

While the invention has been shown and described in what is considered to be a practical and preferred embodiment, it is recognized that departures may be made within the spirit and scope of the following claims which, therefore, should not be limited except within the Doctrine of Equivalents.

Now that the invention has been described,

What is claimed is:

1. An apparatus for washing articles with a solution comprising:

at least one holding reservoir structured and disposed to contain a predetermined charge of the solution therein, a wash basin including at least a partially surrounding wall structure, and a floor having a drain means therein for draining the solution from within said wash basin and into said holding reservoir, means for discharging the solution into said wash basin, means for recirculating the solution from said holding reservoir to said discharging means, a distillation chamber being structured and disposed to receive said charge of solution therein, means for releasing and directing said charge of solution from said holding reservoir into said distillation chamber, and including solution containment valve means selectively operable between an open position to release contaminated solution into said distillation chamber and a closed position to either contain the solution in the holding reservoir or to prevent vapors from escaping from said distillation chamber once the cleaning solution has been released from said holding reservoir and is contained within said distillation chamber, heating means structured and disposed for heating the contaminated solution contained in said distillation chamber so as to produce vapors, and a condenser in fluid communication with said distillation chamber and structured and disposed for receipt and condensing of the vapors to yield purified, condensed liquid solution and being further structured and disposed for directing the purified, condensed liquid solution into said holding reservoir.

2. An apparatus for washing articles with a solution comprising:

a holding reservoir for containing the solution, a wash basin including a floor with drain means therein structured and disposed for draining the solution from said wash basin and into said holding reservoir, solution discharge means for recirculating and discharging the solution from said holding reservoir into said wash basin, a distillation chamber operatively associated with said holding reservoir to receive contaminated solution, release means for selectively releasing and directing contaminated solution from said holding reservoir to said distillation chamber, access means for removing accumulated contaminants contained within said distillation chamber, heating means structured and disposed for heating the contaminated solution contained in said distillation chamber so as to produce vapors, and a condenser structured and disposed to condense the vapors from said distillation chamber to yield purified, condensed liquid solution and to direct the purified, condensed liquid solution into said holding reservoir.

3. An apparatus as recited in claim 2 further including vacuum means for creating a vacuum in said distillation chamber in order to lower a vaporization temperature of the cleaning solution.

4. An apparatus as recited claim 2 further including means for rinsing said holding reservoir after release of the contaminated solution into said distillation chamber, said rinsing means being structured and disposed to wash sediment and accumulated contaminants from an interior surface of said holding reservoir into said distillation chamber.

5. An apparatus as recited in claim 2 wherein said drain means includes filter means structured and disposed for passage of the solution therethrough for removing sediment and particulate from the solution prior to entering said holding reservoir.

6. An apparatus as recited in claim 2 wherein said solution discharge means includes a pump within said holding reservoir and a conduit connecting between said pump and a discharge spout, said discharge spout being structured and disposed for discharging solution pumped from said holding reservoir into said wash basin.

7. An apparatus as recited in claim 2 further including a vapor containment valve assembly structured and disposed to be operable between an open position, permitting the solution to flow through said drain means into said holding reservoir, and a closed position, preventing flow of the solution from said wash basin to said holding reservoir and further preventing fumes and vapors from the solution from escaping from within said holding reservoir to atmosphere.

8. An apparatus as recited in claim 2 wherein said release means includes a solution containment valve assembly selectively operable between a closed position to either contain the solution within said holding reservoir or to prevent vapors from escaping from said distillation chamber when said solution is contained therein, and an open position to release the solution from within said holding reservoir into said distillation chamber.

9. An apparatus for washing articles with a solution comprising:

a first solution holding reservoir structured and disposed to contain a predetermined charge of the solution therein, a wash basin including at least a partially surrounding wall structure, and a floor having a drain means therein for draining the solution from within said wash basin and into said first solution holding reservoir, means for discharging the solution into said wash basin, pump means structured and disposed to circulate the solution from said first solution holding reservoir to said discharging means, a distillation chamber being structured and disposed to receive said charge of solution therein, means for releasing and directing said charge of solution from said first solution holding reservoir into said distillation chamber and including solution containment valve means selectively operable between an open position to release contaminated solution into said distillation chamber and a closed position for either containing the solution in said first solution holding reservoir or for preventing vapors from escaping from said distillation chamber once the contaminated solution has been released from said first solution holding reservoir and is contained in said distillation chamber, heating means structured and disposed for heating the contaminated solution contained in said distillation chamber so as to produce vapors, a condenser structured and disposed for receiving and condensing the vapors from said distillation chamber to produce purified, condensed, non-contaminated liquid solution, a second solution holding reservoir structured and disposed to receive the purified, condensed liquid solution from said condenser, and transfer pump means for transferring the purified, condensed liquid solution from said second solution holding reservoir to said first solution holding reservoir.

10. An apparatus as recited in claim 9 further including vacuum means for creating a vacuum in said distillation chamber in order to lower a vaporization temperature of the solution.

11. An apparatus as recited in claim 10 wherein said vacuum means includes a liquid ring vacuum pump.

12. An apparatus as recited in claim 11 wherein said liquid ring vacuum pump is operable using the purified, condensed liquid solution.

* * * * *